US011572228B2

(12) United States Patent
Jian et al.

(10) Patent No.: US 11,572,228 B2
(45) Date of Patent: Feb. 7, 2023

(54) FOLDABLE CONTAINER

(71) Applicant: SHANGHAI HONGYAN RETURNABLE TRANSIT PACKAGINGS CO., LTD, Shanghai (CN)

(72) Inventors: Yuanli Jian, Shanghai (CN); Kai Gong, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 413 days.

(21) Appl. No.: 15/537,200

(22) PCT Filed: Dec. 15, 2015

(86) PCT No.: PCT/CN2015/097473
§ 371 (c)(1),
(2) Date: Jun. 16, 2017

(87) PCT Pub. No.: WO2016/095813
PCT Pub. Date: Jun. 23, 2016

(65) Prior Publication Data

US 2017/0341857 A1 Nov. 30, 2017

(30) Foreign Application Priority Data

Dec. 16, 2014 (CN) ..... 201410783559.6

(51) Int. Cl.
*B65D 88/52* (2006.01)
*B65D 19/18* (2006.01)
*B65D 6/18* (2006.01)

(52) U.S. Cl.
CPC ..... *B65D 88/522* (2013.01); *B65D 11/1833* (2013.01); *B65D 19/18* (2013.01);
(Continued)

(58) Field of Classification Search
CPC .. B65D 88/522; B65D 11/1833; B65D 19/18; B65D 2519/00611; B65D 2519/00069;
(Continued)

(56) References Cited

U.S. PATENT DOCUMENTS 4,343,415 A * 8/1982 Radek ..... A47K 10/422 221/59
5,938,059 A 8/1999 Luburic
(Continued)

FOREIGN PATENT DOCUMENTS

CN 201729430 2/2011
CN 102502124 6/2012
(Continued)

OTHER PUBLICATIONS

International Search Report issued in PCT/CN2015/097473, dated Mar. 14, 2016, 7 pages.

*Primary Examiner* — Anthony D Stashick
*Assistant Examiner* — Raven Collins
(74) *Attorney, Agent, or Firm* — Hamre, Schumann, Mueller & Larson, P.C.

(57) ABSTRACT

A foldable container comprises a base and two pairs of side plates. The side plates are mounted on the base by means of a hinge mechanism in manner of being foldable relative to the base. The hinge mechanism is provided with an elastic reset structure, thereby the hinge structure on the side plates moves downwards synchronously in the courses that the side plates overturn from a folding state to an upright state. The hinge structure solves the problem of delay in the falling of a hinge in the prior art, is well adapted to the operation habits of various users, and is simple in structure and skillful in the concept.

14 Claims, 12 Drawing Sheets

(52) U.S. Cl.
CPC ..... *B65D 2519/009* (2013.01); *B65D 2519/00034* (2013.01); *B65D 2519/00069* (2013.01); *B65D 2519/00174* (2013.01); *B65D 2519/00318* (2013.01); *B65D 2519/00333* (2013.01); *B65D 2519/00497* (2013.01); *B65D 2519/00611* (2013.01); *B65D 2519/00656* (2013.01)

(58) Field of Classification Search
CPC .... B65D 2519/009; B65D 2519/00656; B65D 2519/00034; B65D 2519/00497; B65D 2519/00333; B65D 2519/00318; B65D 2519/00174; B65D 21/086; B65D 2519/00587; B65D 11/1866; B65D 7/30; B65D 90/02; E05D 3/022; E05D 11/2014; E05Y 2900/602; E05Y 2900/604
USPC ..... 220/4.34, 692, 682, 4.33, 4.28, 7, 6; 267/69–74
See application file for complete search history.

(56) References Cited

U.S. PATENT DOCUMENTS

| | | | | |
|---|---|---|---|---|
| 8,413,301 | B2 * | 4/2013 | Fang | E05F 1/1058 16/286 |
| 9,919,833 | B2 * | 3/2018 | Jian | B65D 21/086 |
| 2005/0150892 | A1 * | 7/2005 | Miller | B65D 19/18 220/324 |

FOREIGN PATENT DOCUMENTS

| | | |
|---|---|---|
| CN | 103043331 | 4/2013 |
| CN | 104554980 | 4/2015 |
| DE | 4029865 | 3/1992 |
| JP | 10119964 | 12/1998 |
| WO | 2007071942 | 6/2007 |

* cited by examiner

FOLDABLE CONTAINER

FIELD

The present invention relates to a container, in particular, a foldable container, such as a turnover box.

BACKGROUND

The current plastic large-sized foldable container is mostly composed of a base and two pairs of side plates, which are connected to the base by a hinge mechanism so that each side plate can be rotated relative to the base then be folded to the base. In general, one pair of the side plates is longer and the other is shorter, and an optional side plate can be provided with a small door. The hinge mechanism is often designed such that the side plates can be folded disorderly, i.e., the two opposite side plates can be folded in any order at the time of folding so that user is not necessary to consider about the order of folding when folding the side plates, and the folding action would be accomplished no matter which one of the opposite side plates is folded first. Therefore, the hinge mechanism is also referred to as a disordered hinge. The above design reduces the cost of production, and eliminates the inconvenience of production and management resulted from the different opposite side plates of the conventional ordered hinge folding container. Such inventions are known as the patent applications such as CN201110295485.8 and U.S. Pat. No. 5,938,059A, and so on.

However, the applicant have found that there is a drawback to the above disordered hinge mechanism that after the opposite side plates using the disordered hinges are folded, the later folded side plate lies on the first folded side plate, and the hinge mechanism is lifted by a height. When the side plates are required to stand upright, the hinge portion of the side plate placed at the top is required to fall to the beginning position on the base during rotation from the lying position to the upright position. If the upper side plate overturns to upright or near the upright but the hinge portion is not fully fallen, some of the structures on the side plate, such as the latch of the side plate engaging with the base, would interfere with the base, and the hinge mechanism of the side plate or parts of the base may be damaged.

SUMMARY

The object of the present invention is to provide a method of solving the problem that the hinge of the side plates are delayed falling when the side plate overturns from the folded state to the upright state in the foldable container.

In order to achieve the above object, the present invention provides a foldable container comprising a base and two pairs of side plates, the side plates are mounted on the base via a hinge mechanism in a manner of being foldable relative to the base, wherein the hinge mechanism comprises:

at least one projecting portion extending from a bottom of one of the side plates and provided with a hinge pin mounting portion, at least one open side portion provided on the base for cooperating with the projecting portion and provided with a guide structure;

a connector being movable up and down along the guide structure and provided with a hinge pin for engaging with the hinge pin mounting portion, wherein the hinge pin is rotatably housed in the hinge pin mounting portion, and an elastic member with one end connected to the base and the other end connected to the connector, so that the elastic member applies force to the connector during rotation process of the side plates from folded state to upright state so as to drive the connector to move downwardly.

Preferably, the elastic member is compressed when the side plates are in compressed station In a preferred embodiment, the guide structure is provided with an elastic member housing slot and the elastic member is housed in the elastic member housing slot, and upper end of the elastic member is connected to the base and lower end of the elastic member is connected to the connector.

In a preferred embodiment, the elastic member is a spring, and the guide structure includes a spring housing slot and the spring is housed in the spring housing slot, and the upper end of the spring is defined by the cover plates which are fixed on the base and lower end is connected to the connector.

In a preferred embodiment, the guide structure is a straight column provided on open side portion, and an elastic member housing slot is provided in the straight column, and the elastic member is housed in the elastic housing slot; and the hinge pin is provided on outer side of the connector, and the center of the connector is provided with a through groove along height direction of the container, and an elastic mounting post is provided in the through groove, wherein the through groove of the connector is sleeved in the straight column and the elastic member mounting column is connected to the lower end of the elastic member and the upper end of the elastic member is blocked by the cover plate located on the through groove.

Preferably, the projecting portion is provided with a groove for avoiding the straight groove.

In a preferred embodiment, there are ribs between the straight column and the base.

In a preferred embodiment, both sides of upper portion of the straight column is provided with a groove and the cover plate is provided with a hanging projection, and the hanging projection is inserted into the groove so that the cover plate is connected to the straight column and the upper end of the elastic member abuts against the bottom of the cover plate.

In a preferred embodiment, the hinge pin includes a straight gap, and the hinge pin mounting portion is an opening groove with a boss provided on mouth, so that the mouth of the opening groove has a width smaller than the diameter of the hinge pin and longer than width of the portion of the hinge pin provided with the straight gap.

In a preferred embodiment, the guide structure is a guide groove provided on both sides of the open side portion, and the elastic member is housed in in the guide groove; and the middle portion of the connector is the hinge pin, and both ends of the connector are respectively provided with the elastic member connecting portion for housing the guide groove on both sides of the open side portion, wherein upper end of the elastic member is blocked by the cover plate and lower end of the elastic member is connected to the elastic member connecting portion.

In a preferred embodiment, the elastic member is a spring, and a sliding lug is extended from both ends of the connector, and the elastic member mounting portion is a cam pin provided on the sliding lug, and lower end of the spring is sleeved on the cam pin.

In a preferred embodiment, both sides of the projecting portion is provided with a hanging projection respectively, and the base is provided with a hanging groove, and the hanging projection is engaged with the hanging groove so as to block side plate to move up and down relative to the base in upright state.

According to another aspect of the present invention, another foldable container is provided, comprising a base and two pairs of side plates, the side plates are mounted on the base via a hinge mechanism in the manner of being foldable relative to the base, wherein the hinge mechanism comprises:

at least one projecting portion extending from a bottom of one of the side plate and provided with a hinge pin;

at least one open side portion provided on the base for cooperating with the at least one projecting portion and provided with a guide groove, and the hinge pin is housed in the guide groove and be movable up and down along the guide groove;

an elastic member with one end connected to the base and other end is connected to projecting portion, so that the elastic member applies force to the connector during rotation process of the side plate from folded state to upright state so as to drive the connector to move downwardly.

In a preferred embodiment, the open side portion is provided with an elastic member housing slot and the elastic member is housed in the elastic member housing slot, and upper end of the elastic member is connected to the projecting portion and lower end is secured in the elastic member housing slot.

Preferably, the hinge pin is provided on one side or both sides of the projecting portion, and middle portion of the projecting portion is provided with a hanging pin; the elastic member is a spring, and one end of the spring has a hook; wherein one end of the spring is secured in the elastic housing groove, and other end with the hook is connected to the hanging pin.

Benefit:

The invention solves the delay in the falling of the hinge mounted on the side plates of the large-sized container and is well suited to the operating habits of the various users, and the structure is novel and the idea is ingenious.

DETAILED DESCRIPTION

Preferred embodiments of the present invention will be described in detail with reference to the accompanying figures in order to provide a clearer understanding of the objects, features and advantages of the present inventions. It should be appreciated that the embodiments shown in the figures are not intended to limit the scope of the protection of the invention, but merely to illustrate the spirit of the invention.

The directional terms, such as "up","down","upright" and the like, refer to the orientation of the figures or the orientation of the container of the present invention in normal use state.

Figure 1:
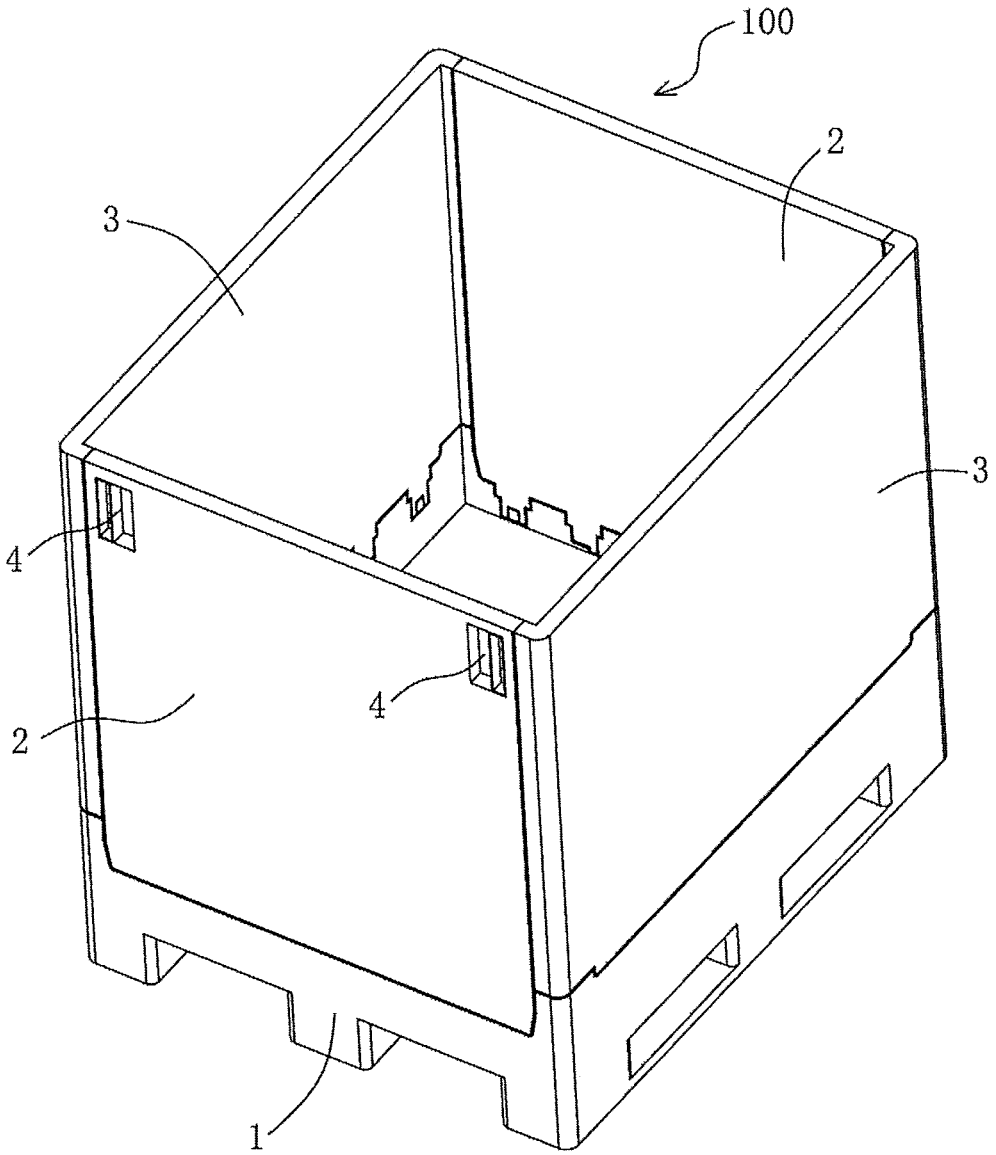
FIG. 1 is a perspective structural view of a general large-sized foldable container.
Figure 2:
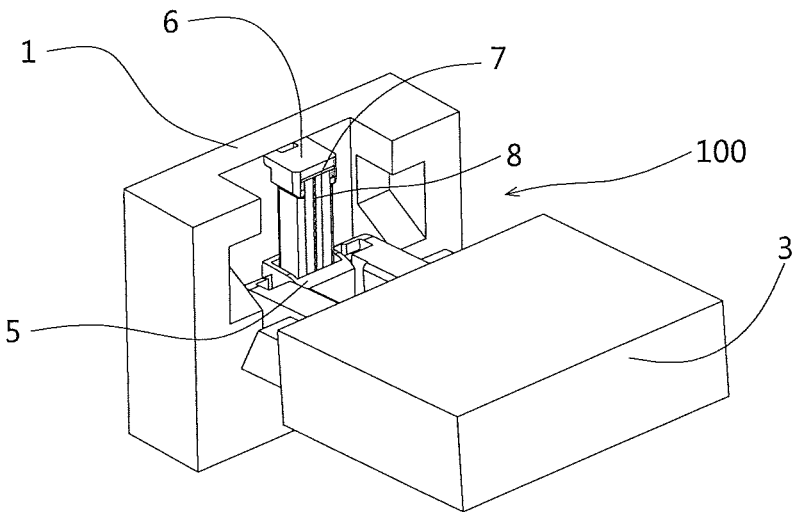
FIG. 2 is a schematic structural view of the hinge mechanism of the foldable container according to the first embodiment of the present invention, and only a portion of the side plate and the base is shown for clarity.
Figure 3:
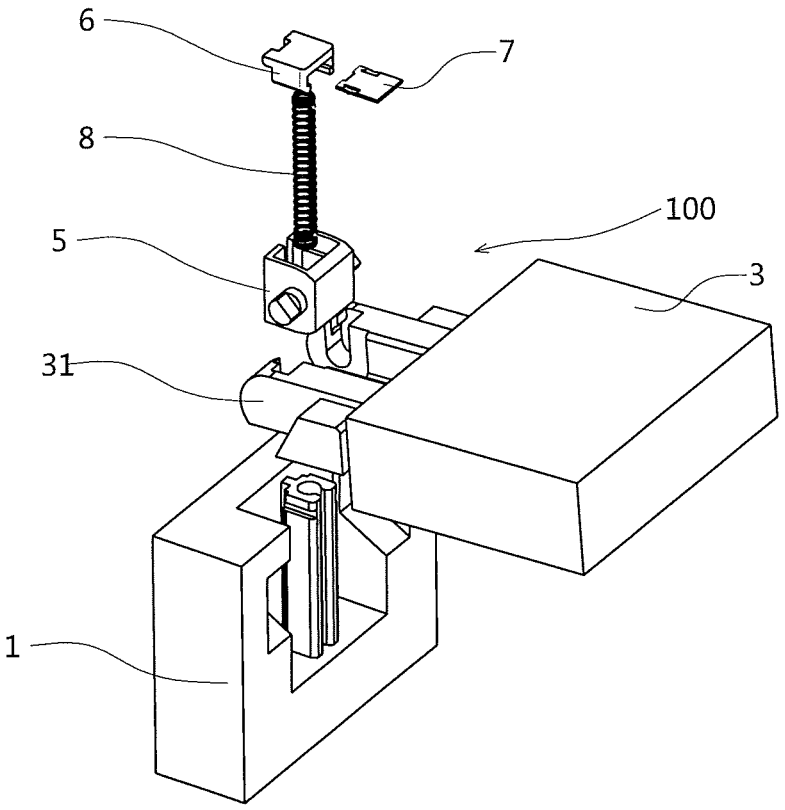
FIG. 3 is an exploded perspective view of FIG. 2.

As shown in FIG. 1, general foldable large-sized containers comprises a base 1 and two pairs of side plates 2, and each side plate 2 is mounted on the base 2 by means of a hinge mechanism in manner of being foldable relative to the base 2. These containers are generally made of plastic material. A latch 4 is generally provided on the side plate 2 for controlling connection between the adjacent side plates 2 and 3, so as to complete the transition of the side plates 2, 3 between folded state and upright state. Optionally, the side plates 2, 3 may have a small door (not shown), and optionally a lid (not shown) is placed at the top of the container.

For the sake of simplicity, in the following embodiments, only some parts of the side plates and the base are applied to combine with the present hinge for illustrating.

FIGS. 2~12 show a hinge mechanism 100 according to a first embodiment of the present invention. As shown in FIGS. 2-9, the hinge mechanism comprises: at least one projecting portion 31 extending from the bottom portion of the side plate 3 and being provided with a hinge pin mounting portion 35, in particular a hinge groove 35; an open side portion 11 provided on the base 1 and cooperating with the projecting portion 31, wherein the open side portion 11 has a guide structure 14, in particular a straight column 14; a connector 5 which can move up and down along the column 14 so that the connector 5 can move up and down relative to the base 1, and the connector 5 has a hinge pin 51 which engages with the hinge groove 35, and the hinge pin 51 is housed and rotatable in the hinge groove 35 so that the side plate 3 can be mounted rotatablely on the connector 5; and an elastic member 8, in particular a spring 8, one end of which is connected to the base 1 and the other end is connected to the connector 5, specifically, the upper end of the spring 8 abuts against the cover plate 6, and the lower end of the spring 8 is connected to the connector 5, so that the elastic member applies force to the connector during the rotation of the side plate from folded state to upright state, so as to drive the connector 5 to move downwardly, as will be described in detail below.

Alternatively, a tamper-evident piece 7 can be inserted between the cover plate 6 and the base so as to prevent the side plate from being removed without being perceived.

Figure 4:
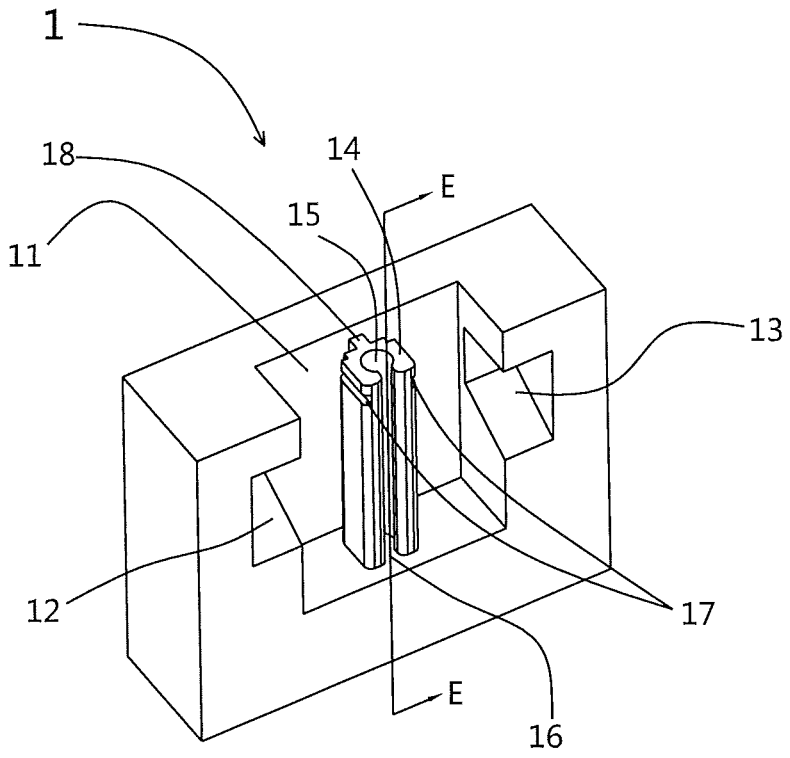
FIG. 4 is a perspective structure view of the base of the base in FIG. 2.
Figure 5:
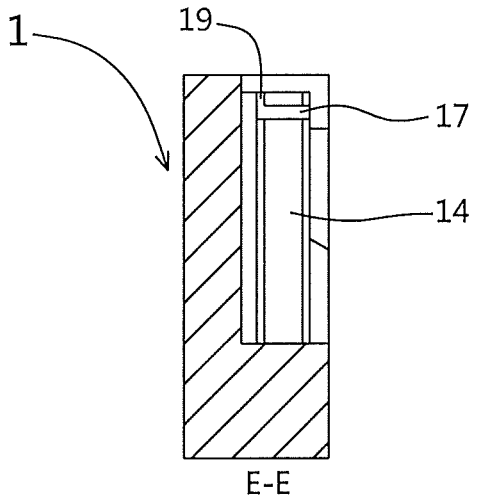
FIG. 5 is a cross-sectional view taken along section line E-E of FIG. 4.

FIGS. 4 and 5 show the structure associated with the hinge mechanism of the base 1. The base 1 has an open side portion 11 and two hanging grooves 12, 13 on both sides of the open side portion 11. The middle portion of the open side portion 11 is provided with a straight post 14, in the center of which is provided with a spring groove 15 for accommodating the spring 8. A rib 18 is connected between the straight post 14 and the base 1 to ensure the strength of the straight post 14. Both sides of the upper portion of straight post 14 is provided with a slot 17 and a groove 19 for cooperating with the cover plate 6 to secure the cover plate, which will be further described below in detail.

Figure 6:
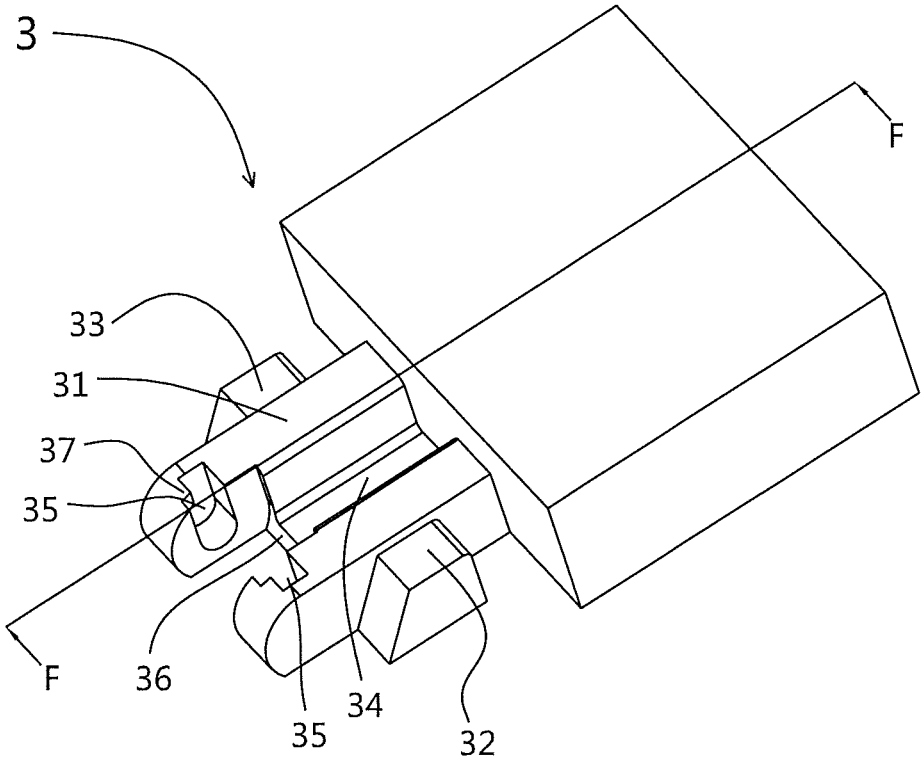
FIG. 6 is perspective structural view of the portion of side plate in FIG. 2.
Figure 7:
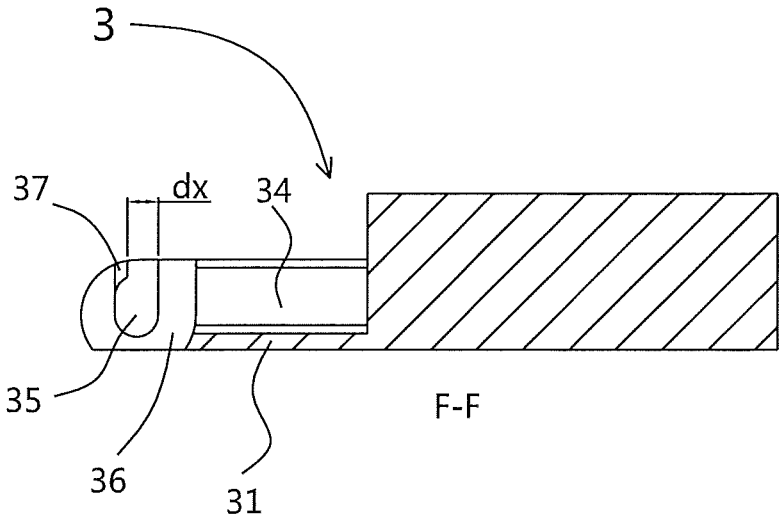
FIG. 7 is a cross-sectional view taken along section line F-F of FIG. 6.
Figure 8:
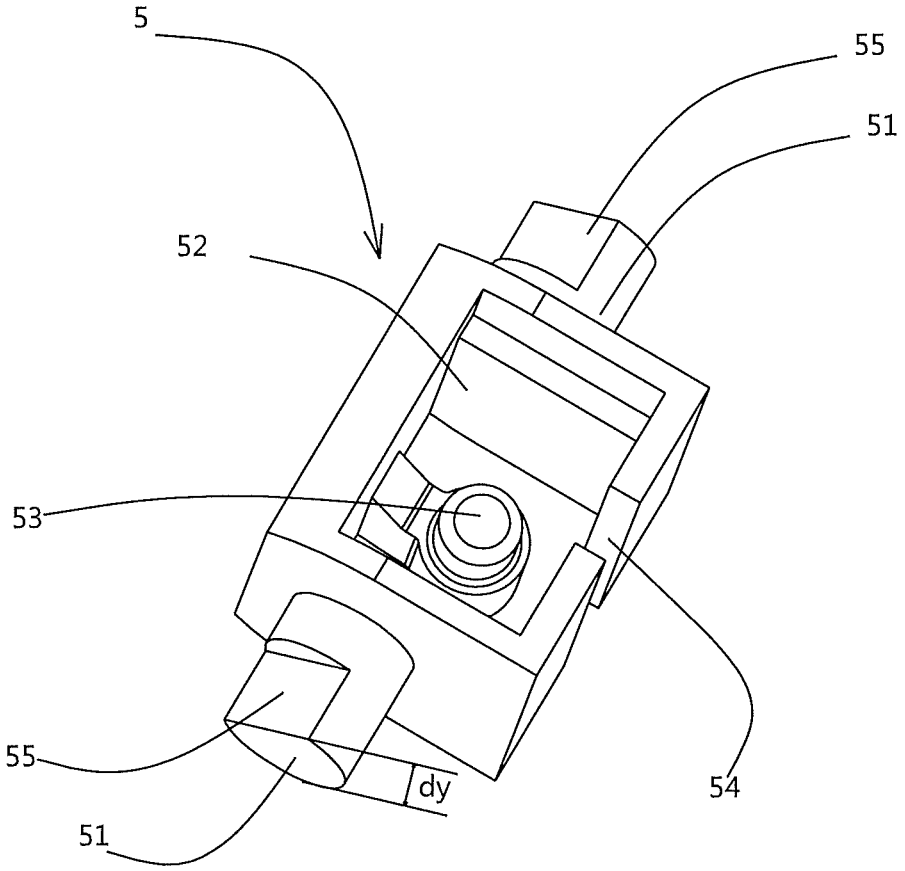
FIG. 8 is a perspective view of the connector in FIG. 2.

FIGS. 6 and 7 show the structure associated with the hinge mechanism on the side plate 3. A projecting portion 31 is provided on the bottom of side plate. On both sides of the projecting portion 3 is provided with hanging projections 32, 33 to cooperate with the hanging grooves 12 and 13 of the base 1, so as to restrict the vertical movement of the side plate 3 relative to the base 1 in upright state. The middle portion of the projecting portion 31 is provided with a recess 34 for avoiding the straight column 14 and a recess 36 for receiving the connector 5. Both sides of the recess 36 is provided with a hinge grooves 35, and the mouth portion of the hinge groove is provided with a small boss 37, so that the mouth of the hinge groove 35 has a width dx.

The structure of the connector 5 is shown in FIG. 7. Two hinge pins 51 are provided on both sides of the connector body respectively. The hinge pins 51 have a straight gap 55 at a certain angle (during rotation of the side plates, the hinge pin would not be rotated to the certain angle, so that the hinge pin would not escape from the hinge slot or hinge hole during the rotation), so that the hinge pin 51 has a width dy slightly shorter than the width dx. In such way, only at the certain angle, can the connector 5 be installed in the hinge groove 35 of the side plate 3. It should be noted that the above small boss 37 and straight gap 55 is provided to prevent the hinge pin from escaping from the hinge hole or hinge slot during rotation. However, any other suitable structure known in the art may also be employed for achieving the same purpose.

The middle portion of the connector 5 is a through groove 52 for passing through the straight column 14 of the base 1 and the through groove 52 can move up and down for a certain distance along the straight column 14. The middle of the through groove 52 is provide with a spring mounting post 53 for mounting the spring 8, with a chamfer 56 to increase connection strength of the spring mounting post 53 and the body of the connector 5 and with a slot 54 to avoid the rib 18 of the base 1.

Figure 9:
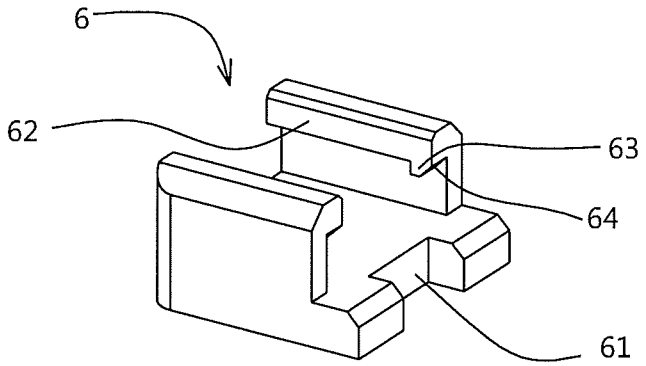
FIG. 9 is a perspective view of the cover plate in FIG. 2.

FIG. 9 shows the detailed structure of the cover plate 6, which extends inwardly and forms two hanging projections 62. The hanging projection 62 has a position limiting projection 63 on the beginning end inserting into the slot 17 of the base 1*a* guiding bevel 64. The cover plate 6 is further provided with a slot 61 which can cooperate with a flat-blade screwdriver tool.

Figure 10:
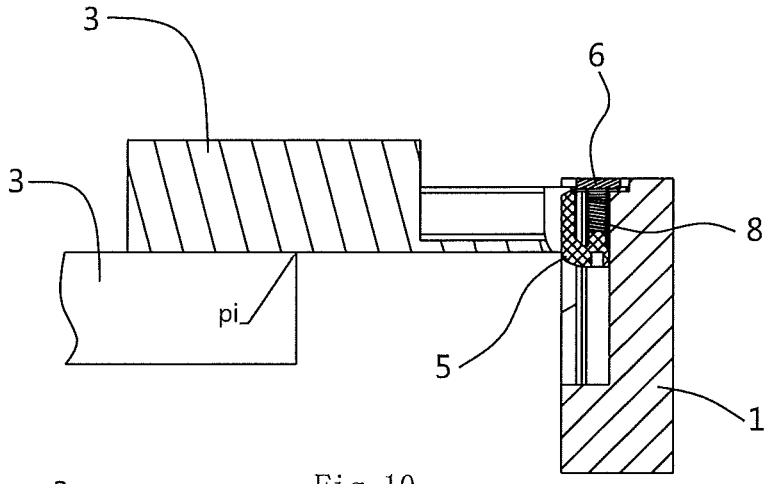
FIGS. 10-12 is a cross-sectional view showing process of the side plate during rotation from the folded state to upright state.
Figure 11:
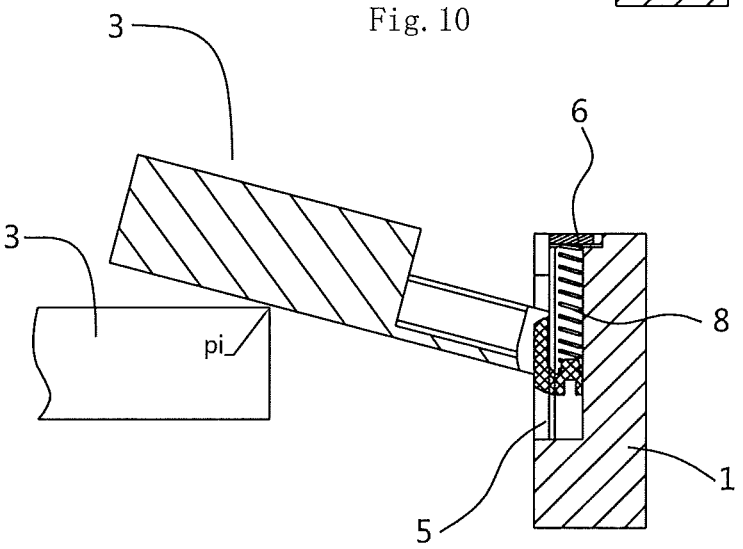
Figure 12:
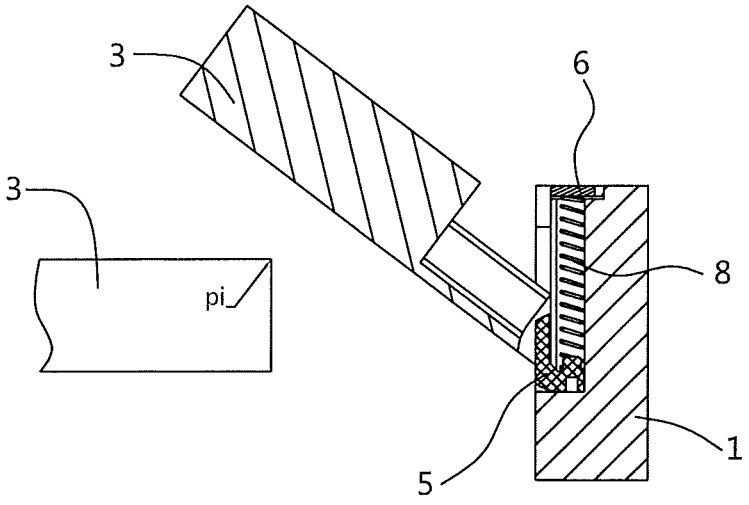
Figure 13:
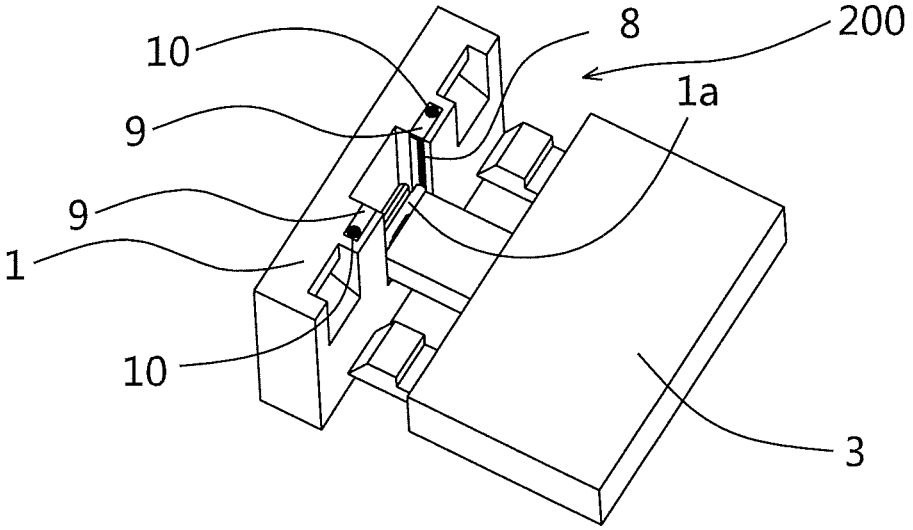
FIG. 13 shows a schematic view of the hinge mechanism of the foldable container according to the second embodiment of the present invention, and only a portion of the side plate and the base is shown for clarity.
Figure 14:
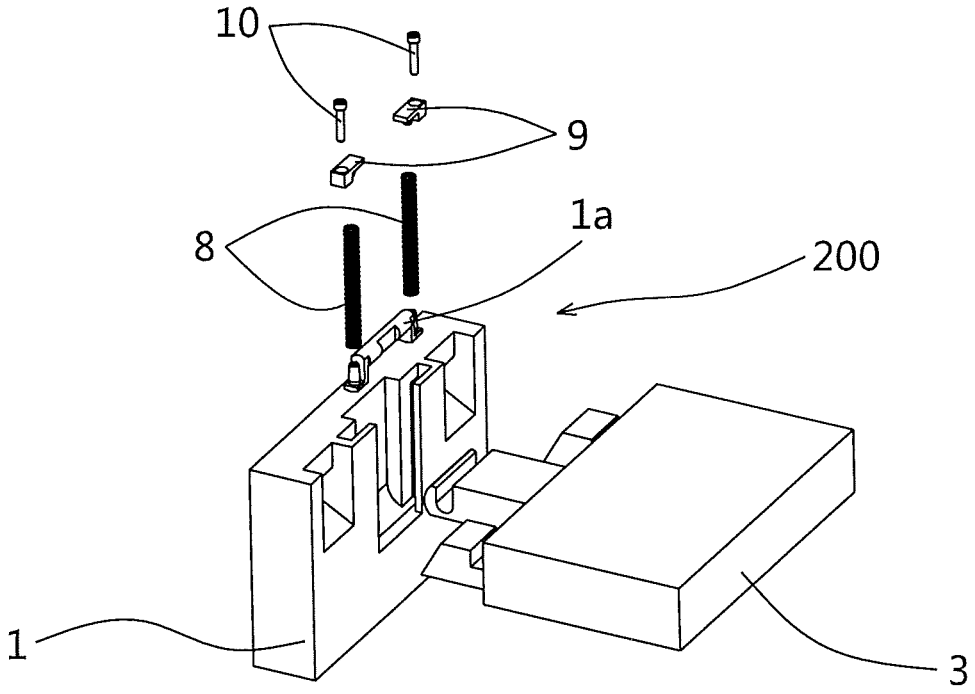
FIG. 14 is an exploded perspective view of FIG. 13.
Figure 15:
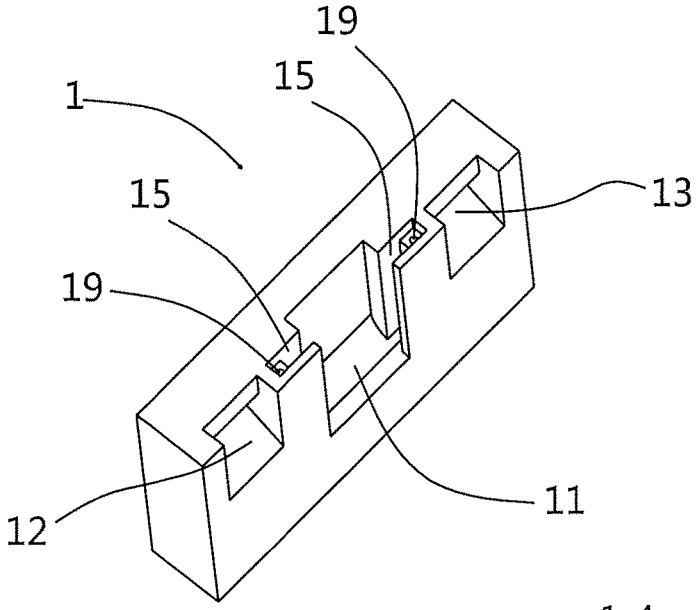
FIG. 15 is a perspective structure view of the portion of the base in FIG. 13.
Figure 17:
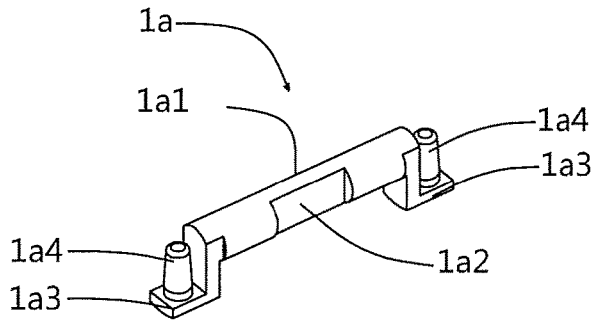
FIG. 17 is a perspective view of the connector in FIG. 13.
Figure 16:
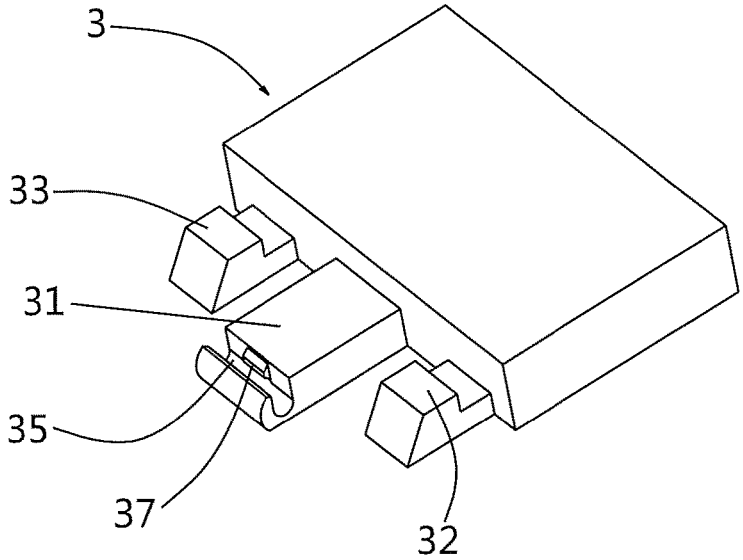
FIG. 16 is a perspective structure view of the portion of the side plate in FIG. 16.
Figure 18:
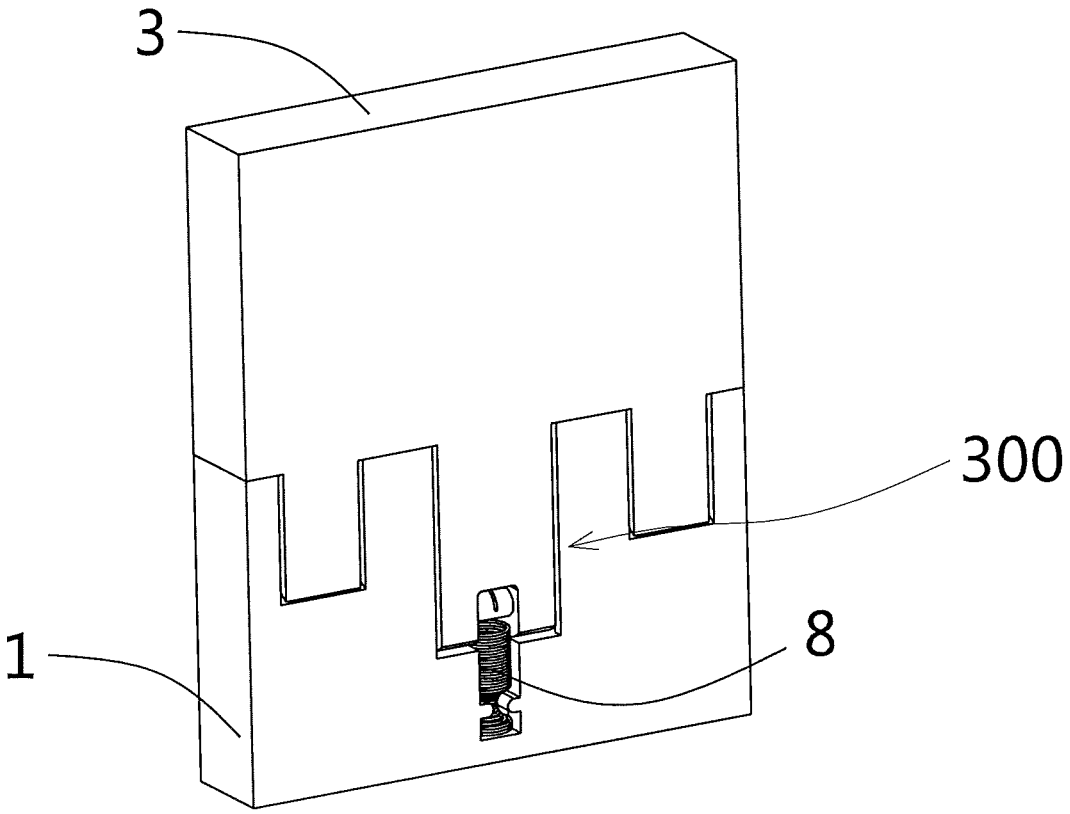
FIG. 18 shows a schematic view of the hinge mechanism of the foldable container according to the third embodiment of the present invention.
Figure 19:
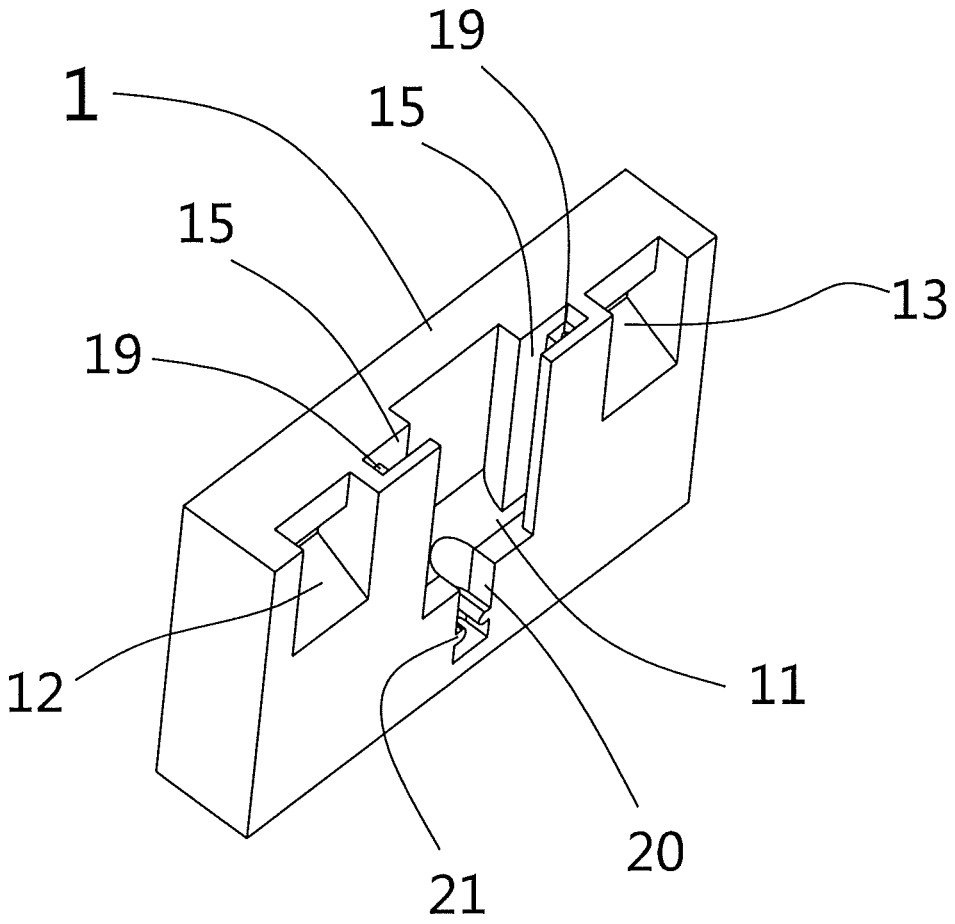
FIG. 19 is a perspective structure view of the portion of the base in FIG. 18.
Figure 20:
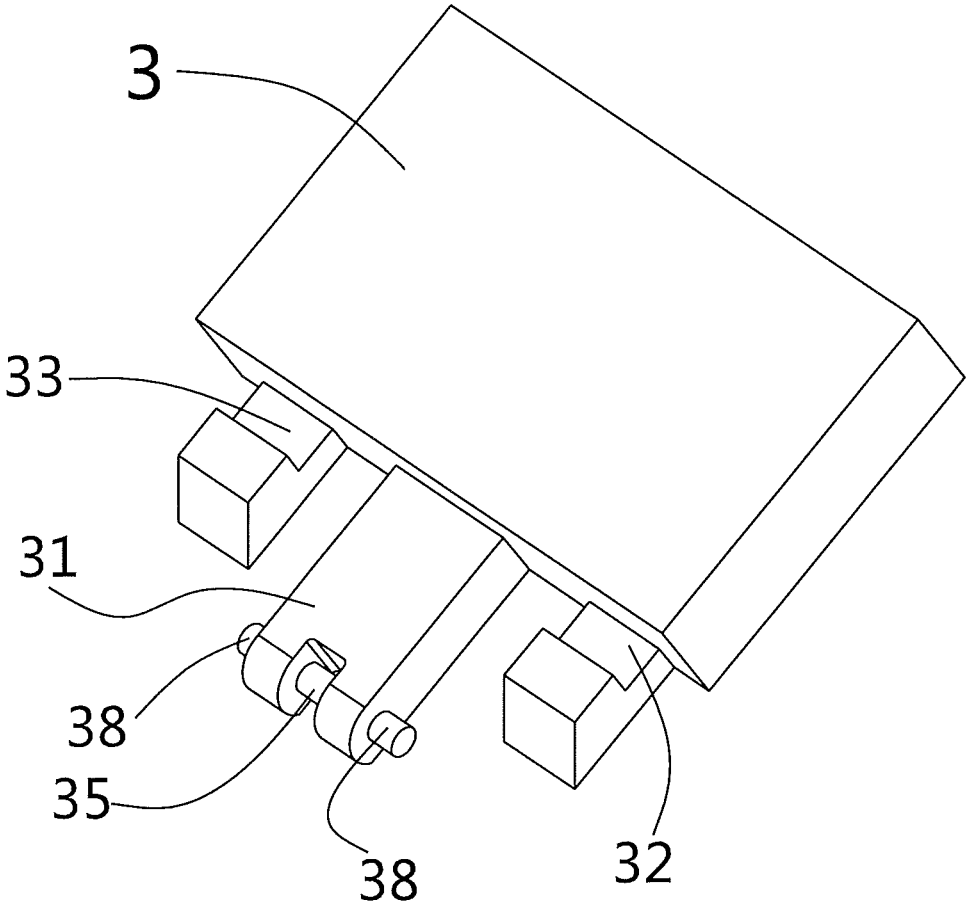
FIG. 20 is a perspective structural view of the portion of the side plate in FIG. 18.
Figure 21:
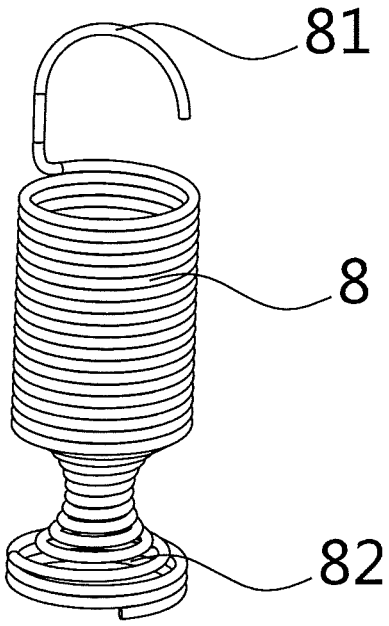
FIG. 21 is a perspective view of the spring in FIG. 18.

The operation of the hinge mechanism of the present embodiment is shown in FIGS. 10~12. After the large-sized container is folded, one of the two opposite side plates 3 later folded is laid on the other firstly folded, and the hinge portion of the one later folded is raised by a distance equal to about the thickness of one side plate, when the spring 8 is compressed to be in charge state but its strength is insufficient to lift the side plate 3 with a point pi as fulcrum. When the first side plate 3 is rotated to upright, there may be two fulcrums depending on the different operation habits: one is the fulcrum pi, the other is the hinge pin 51 of the connector 5. When the side plate 3 is rotated with the point pi as the fulcrum, the hinge mechanism would automatically move down by a certain distance along the straight column 14 of the base 1. When the side plate 3 is rotated around the hinge pin 51, the side plate 3 placed above would be moved away from the fulcrum pi during the rotation, where the spring 8 releases its potential energy to push the hinge mechanism moving down along the straight column 14.

Regardless of which fulcrum, when the side plate 3 is rotated to a certain angle, it will be far away from the fulcrum pi and at same time the hinge mechanism will be pushed to the bottom of the open side portion 11 of the base 1 by the elastic forth of the spring, so that the hanging projections 32, 33 of the side plates would advance to be inserted into the pre-aligned position of the hanging grooves 12 and 13, avoiding the failure of pre-alignment between the hanging projections 32, 33 and hanging grooves 12, 13 for the conventional disordered hinge resulted from drop delay due to rely on the self-weight of the side plate 3 to fall down, so as to prevent the side plate from interfering with the base 1 during the opening process.

It should be appreciated that in the above embodiment, a force is applied to the connector by spring. However, it is also possible to apply forth on the connector by other elastic members, such as rubber blocks, so as achieve the technical effect of the present invention.

It also should be appreciated that in the above embodiment, the spring is placed above the connector, i.e., the upper portion of the spring is connected to the base, and the lower portion is connected to the connector 5, so that the spring is compressed when the foldable container is in foldable state, and the compressed spring is gradually released during the process that the side plate is rotated from the folded state to the upright state, thereby applying a downward pressure to the connector to drive the connector to move downwardly.

However, the spring (or the other elastic member) may also be placed under the connector, i.e., the upper portion of the spring is connected to the connector, and the lower portion is connected to the base, so that the spring is stretched when the foldable container is folded and the spring is retracted during the process that the side plate is rotated from the folded state to the upright state, thereby applying the upward force to the connector so as to drive the connector to move downwardly.

FIGS. 13~17 show the hinge mechanism 200 according to the second embodiment of the present invention. With respect to the above embodiment, the hinge mechanism 200 of the embodiment is provided with two springs 8 for resetting the hinge mechanism, and the cover plate 9 is secured by screw, which slightly increase the mounting difficulty, but appropriately reduce the difficulty of manufacturing parts.

Specifically, the side plate 1 has an open side portion 11, which has guide grooves 15 provided on both sides, so that the connector 1*a* can move up and down for a certain distance along the groove. A screw hole 19 for mounting screw 10 is provided next to the guide groove 15, and hanging grooves 12, 13 are distributed on both sides of the open side portion 11. The projecting portion 31 of the side plate 3 is provided with hinge slot 35, and the mouth portion of the hinge slot 35 is provided with a small boss 37 with the same function as in the above-described embodiment, and the hanging projections 32 are distributed on both sides of the projecting portion 31. The body of the connector 1*a* is a level pin 1a1, and both ends of the level pin 1a1 are provided with a sliding lug 1a3 with a convex 1a4 serving as a spring mount. The spring 18 can be mounted on the sliding lug 1a3 which can move up and down in the guide groove 15. Similar to the first embodiment, the level pin 1a1 has a vertical notch 1a2 so that only when the side plate 3 is in the folded laying state would the connector be inserted into the hinge groove 35.

The operation of the hinge mechanism of the present embodiment is similar to that of the above-described first embodiment and will not be described in detail herein.

FIGS. 18~21 show the structure of the hinge mechanism 300 of the foldable container according to the third embodiment of the present invention. The present embodiment is similar to the second embodiment, the main difference between them is in this embodiment, the connector is integrally formed with the projecting portion of the side plate, and meanwhile tension spring 8 is used as the elastic member. One end of the tension spring 8 is connected to the base, and the other end is connected to the projecting portion so that the tension spring 8 will apply a pulling force to the projecting portion 31 during the rotation of the side plate from the folded state to upright state, so as to drive the projecting portion 31 to move downwardly.

Specifically, as in the second embodiment, the hanging projections 32, 33 are provided on both sides of the projecting portion 31 of the side plate 3, and the hanging grooves 12 and 13 are provided on both sides of the groove of the base. The guide groove 15 is provided on both side surfaces on the groove of the base. The screw hole 19 for mounting the cover plate (similar to the cover plate 9 in FIG. 14) is provided on the mouth portion of the guide groove. Unlike the second embodiment, the mounted cover plate can limit the distance of the side plate hinge pin 38 floating in the guide groove to prevent it from coming off. A hanging pin 35 for connecting the hook 81 of the tension spring 8 is provided under the middle of the projecting portion 31 of the side plate, so as to make one end of the tension spring connect to the projecting portion. A slot 20 for housing the tension spring is provided at the bottom portion of the base recess 11. The slot 20 has a boss to connect and limit the other end 82 of the tension spring. In such way, the tension spring can quickly bring the side plate back to its position when the side plate float above the straight groove after being folded.

The hinge mechanism of the present invention use elastic reset structure and thus allows that during the rotation of the side plate from the folded state to the upright state the connector of the hinge mechanism is forced to move downwardly, thereby driving the side plate which is connected to the connector to move downwardly, so as to solving the problem of damage to parts caused by the late drop of the side plate hinge. By using the hinge mechanism of the present invention, drop of the hinge would not be delayed no matter how the operators operate, where the center of gravity is and how the tolerance mates between the hinge of the side plate and the base, and thereby completely solving the problem of accidental damage of the container during the rotation of the side plate from the folded state to upright state.

The present invention is particularly suitable for the large-sized container, in particular the large-sized foldable turnover boxes. The large-sized container herein refers to the container with a capacity of more than 800 L.

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

The invention claimed is:

1. A foldable container comprising a base and two pairs of side plates, the side plates are mounted on the base via a hinge mechanism in a manner of being foldable relative to the base, wherein the hinge mechanism comprises:

at least one projecting portion extending from a bottom of one of the side plates and provided with a hinge pin mounting portion, at least one open side portion provided on the base for cooperating with the projecting portion and provided with a guide structure, a connector being movable up and down along the guide structure and provided with a hinge pin for engaging with the hinge pin mounting portion, wherein the hinge pin is rotatably housed in the hinge pin mounting portion, and an elastic member with one end connected to the base and other end connected to the connector, so that the elastic member applies force to the connector during rotation process of the side plates from folded state to upright state so as to drive the connector to move downwardly, wherein upper end of the elastic member is blocked by a cover plate and lower end of the elastic member is connected to an elastic element connecting portion, wherein both sides of the projecting portion is provided with a hanging projection respectively, and the base is provided with a hanging groove, and the hanging projection is engaged with the hanging groove so as to block the side plate to move up and down relative to the base in upright state.

2. The foldable container according to claim 1, wherein the guide structure is provided with an elastic member housing slot and the elastic member is housed in the elastic member housing slot, and upper end of the elastic member is connected to the base and lower end of the elastic member is connected to the connector.

3. The foldable container according to claim 1, wherein the elastic member is a spring, and the guide structure includes a spring housing slot and the spring is housed in the spring housing slot, and upper end of the spring is blocked by the cover plate which is fixed on the base and lower end is connected to the connector.

4. The foldable container according to claim 1, wherein the guide structure is a straight column provided on the open side portion, and an elastic member housing slot is provided in the straight column, and the elastic member is housed in the elastic member housing slot; and the hinge pin is provided on outer side of the connector and the center of the connector is provided with a through groove along height direction of the container, and an elastic mounting post is provided in the through groove, wherein the straight column passes through the through groove of the connector and an elastic member mounting column is connected to lower end of the elastic member and upper end of the elastic member is blocked by the cover plate located on the through groove.

5. The foldable container according to claim 4, wherein ribs are connected between the straight column and the base.

6. The foldable container according to claim 4, wherein both sides of upper portion of the straight column is provided with a groove and the cover plate is provided with a hanging projection, and the hanging projection of the cover plate is inserted into the groove so that the cover plate is connected to the straight column and upper end of the elastic member abuts against bottom of the cover plate.

7. The foldable container according to claim 4, wherein the hinge pin includes a straight gap, and the hinge pin mounting portion is an opening groove with a boss provided on mouth, so that the mouth of the opening groove has a width shorter than the diameter of the hinge pin and longer than width of portion of the hinge pin provided with the straight gap.

8. The foldable container according to claim 1, wherein the guide structure is a guide groove provided on both sides of the open side portion, and the elastic member is housed in the guide groove; and the middle portion of the connector is the hinge pin, and both ends of the connector are respectively provided with the elastic member connecting portion for housing the guide groove on both sides of the open side portion.

9. The foldable container according to claim 8, wherein the elastic member is a spring, and a sliding lug is extended from both ends of the connector, and an elastic member mounting portion is a cam pin provided on the sliding lug, and lower end of the spring covers the cam pin.

10. The foldable container according to claim 1, wherein ribs are connected between the guide structure and the base.

11. The foldable container according to claim 1, wherein both sides of upper portion of the guide structure is provided with a groove and the cover plate is provided with a hanging projection, and the hanging projection of the cover plate is inserted into the groove so that the cover plate is connected to the guide structure and upper end of the elastic member abuts against bottom of the cover plate.

12. The foldable container according to claim 1, wherein the hinge pin includes a straight gap, and the hinge pin mounting portion is an opening groove with a boss provided on mouth, so that the mouth of the opening groove has a width shorter than the diameter of the hinge pin and longer than width of portion of the hinge pin provided with the straight gap.

13. The foldable container according to claim 1, wherein the elastic member is a spring, and a sliding lug is extended from both ends of the connector, and an elastic member mounting portion is a cam pin provided on the sliding lug, and lower end of the spring covers the cam pin.

14. The foldable container according to claim 1, wherein during the rotation process of the side plates, the elastic member changes from a stretched state to a retracted state or from the retracted state to the stretched state.

* * * * *